US011173593B2

(12) United States Patent
Moreau et al.

(10) Patent No.: US 11,173,593 B2
(45) Date of Patent: Nov. 16, 2021

(54) TETHERING ASSEMBLY AND METHOD FOR GRINDERS AND LIKE TOOLS

(71) Applicant: Pure Safety Group, Inc., Pasadena, TX (US)

(72) Inventors: Darrell A. Moreau, Portsmouth, NH (US); Andre W. Moreau, Deerfield, NH (US)

(73) Assignee: Pure Safety Group, Inc., Pasadena, TX (US)

( * ) Notice: Subject to any disclaimer, the term of this patent is extended or adjusted under 35 U.S.C. 154(b) by 99 days.

(21) Appl. No.: 16/658,483

(22) Filed: Oct. 21, 2019

(65) Prior Publication Data

US 2020/0047323 A1 Feb. 13, 2020

Related U.S. Application Data

(63) Continuation of application No. 15/352,868, filed on Nov. 16, 2016, now Pat. No. 10,449,662.

(51) Int. Cl.

| | |
|---|---|
| ***B25F 5/02*** | (2006.01) |
| ***A45F 5/00*** | (2006.01) |
| ***A45C 13/30*** | (2006.01) |
| ***B25H 3/00*** | (2006.01) |

(52) U.S. Cl.

CPC ..... *B25F 5/02* (2013.01); *A45C 13/30* (2013.01); *A45F 5/00* (2013.01); *B25H 3/00* (2013.01); *A45F 2005/006* (2013.01); *A45F 2200/0575* (2013.01)

(58) Field of Classification Search

CPC ..... B25F 5/02; A45F 2005/006

See application file for complete search history.

(56) References Cited

U.S. PATENT DOCUMENTS

| | | | | |
|---|---|---|---|---|
| 4,820,090 A * | 4/1989 | Chen | B25F 5/027 16/431 |
| 5,049,012 A * | 9/1991 | Cavedo | B25F 5/026 408/241 R |
| 5,130,899 A | 7/1992 | Larkin | |

(Continued)

OTHER PUBLICATIONS

Office Action for U.S. Pat. No. 10,449,662 dated Dec. 13, 2018, 7 pages.

(Continued)

*Primary Examiner* — Jason L Vaughan
*Assistant Examiner* — Amanda Kreiling
(74) *Attorney, Agent, or Firm* — Dicke, Billig & Czaja, PLLC

(57) ABSTRACT

A combination power hand tool and tethering assembly comprises a power hand tool selected from the group consisting of a grinder, a polisher, a cut-off tool, and a drill. The hand tool has a gear housing with a fastener bore configured and arranged to receive a fastener. The tethering assembly comprises a connector having a fastener opening and a tether configured and arranged to be connected to the connector. The fastener extends through the fastener opening and into the fastener bore thereby connecting the connector and the power hand tool. The tether is configured and arranged to be selectively coupled to one of a worker and an anchor object thereby selectively interconnecting the connector and the one of the worker and the anchor object.

13 Claims, 9 Drawing Sheets

(56) References Cited

U.S. PATENT DOCUMENTS

| | | | | |
|---|---|---|---|---|
| 5,201,445 | A * | 4/1993 | Axelman | A45F 5/02 224/148.6 |
| D368,272 | S | 3/1996 | Starr et al. | |
| D377,862 | S | 2/1997 | Moore | |
| D418,774 | S | 1/2000 | Kalbach | |
| 6,679,406 | B2 * | 1/2004 | Sakai | B25B 23/045 173/217 |
| 8,167,056 | B2 | 5/2012 | Ito | |
| 8,443,913 | B2 | 5/2013 | Nagasaka | |
| 8,534,375 | B2 | 9/2013 | Matsumoto | |
| 8,573,322 | B2 * | 11/2013 | Nagasaka | B25F 5/02 173/171 |
| D737,668 | S | 9/2015 | Moreau | |
| D738,709 | S | 9/2015 | Moreau | |
| D797,442 | S | 9/2017 | Moreau | |
| 2002/0179659 | A1 | 12/2002 | Shaw | |
| 2003/0102342 | A1 | 6/2003 | Fogg | |
| 2007/0295885 | A1 * | 12/2007 | Vidal | E06C 7/14 248/682 |
| 2009/0276979 | A1 | 11/2009 | Kauffman | |
| 2016/0095421 | A1 | 4/2016 | Moreau | |
| 2016/0375575 | A1 | 12/2016 | Moreau | |
| 2018/0070713 | A1 | 3/2018 | Moreau | |
| 2018/0132600 | A1 | 5/2018 | Moreau | |
| 2018/0317636 | A1 | 11/2018 | Cirincione | |

OTHER PUBLICATIONS

Office Action for U.S. Pat. No. 10,449,662 dated Mar. 6, 2019, 7 pages.

Notice of Allowance for U.S. Pat. No. 10,449,662 dated Jun. 13, 2019, 7 pages.

* cited by examiner

TETHERING ASSEMBLY AND METHOD FOR GRINDERS AND LIKE TOOLS

BACKGROUND OF THE INVENTION

1. Field of the Invention

The present invention relates generally to safety accessories for hand tools and more particularly to a tethering assembly and method for hand-held power tools, such as grinders, polishers, cut-off tools.

2. Description of the Prior Art

Lanyards, tethers, hooks, and similar restraints are used to arrest accidentally-dropped tools. These restraints are particularly useful in environments where a tool drop can cause substantial damage or harm to plant equipment, workers, or objects below a worker who accidentally drops a tool.

One method of restraining tools is to clip one end of a tether to an opening in the handle of a tool and to clip the other end of the tether to the worker's belt or to a nearby structure. When workers properly tether a tool in this way, a dropped tool can be effectively stopped before it can fall far enough to cause damage or injury. However, due in part to aesthetic preferences and practical design limitations, many hand-held power tools lack attachment points for tethers.

While hand tools sometimes may have openings or tether-attachment points, powered hand tools often do not. In particular, grinders, polishers, and cut-off tools typically have an elongated body attached to a gear housing that includes a motor. The tool body includes a hand grip. In some cases, an elongated push-button is located along the bottom side of the tool body, where the user squeezes the push-button to turn on the motor. The motor rotates the working part of the tool (e.g., an abrasive cut-off wheel) about an axis generally perpendicular to the tool body. A side handle is attached to and extends from one side of the gear housing. The user may use one hand on the grip on the tool body and another hand on the side handle to hold the tool and direct the working part of the tool (e.g., the abrasive cut-off wheel) to the work piece. Since the grip is on the tool body rather than being a separate handle attached to the tool body the tool body lacks a handle with an opening through which a tether could be attached. Therefore, one approach to tethering grinders and the like has been to wrap the tether around the gear housing just behind the side handle and to secure the tether with bonding tape.

SUMMARY OF THE INVENTION

Despite efforts to tether a grinder as discussed above, the approach has proven to be cumbersome and unsafe. For grinders having the push-button on the bottom side of the tool body, the gear housing has very limited space to wrap a tether so that it does not interfere with the button or with the guard. Also, since the tool body usually reduces in size towards the rear end, the bonding tape is prone to slip off the gear housing, especially when the tool body gets hot from use. Further, tethers wrapped around the tool body or gear housing are positioned close to the moving parts. As such, the tether can drape down into the cutting/grinding wheel and become entangled with the rotating tool head or be severed by the grinding/cutting wheel. Even if the tether does not contact the moving part of the tool, it may be burned from sparks emitted from the work piece. Each of these situations results in an unsafe condition to the worker or damage to the tool. For these reasons, the user often foregoes using a tether with these types of tools.

Therefore, a need exists for an improved tethering assembly and method for tethering power hand tools having an elongated tool body and a side handle, such as angle grinders, polishers, cut-off tools and the like.

One aspect of the present invention is directed to a method of tethering a power hand tool. In one embodiment, the method includes providing a power hand tool to be tethered, where the power hand tool has an elongated tool body extending to a gear housing on a forward end of the tool body and defining a plurality of fastener bores. The power hand tool also has a removable side handle installed in one of the fastener bores in the gear housing. A tethering assembly kit is provided, where the kit includes one or more ring connectors each defining a fastener opening and a sling constructed to be connected to the ring connector(s) and defining a tether-connector loop configured for attachment of a tether when the sling is installed on the power hand tool. The fastener opening of each ring connector is aligned with one of the fastener bores in the gear housing. A bolt is installed in a first fastener bore with the bolt extending through the fastener opening of a first ring connector. The sling is connected to the ring connector(s).

In another embodiment where the removable side handle is installed on the power hand tool upon providing the power hand tool, the method includes removing the side handle from the gear housing, thereby revealing a first fastener bore in the gear housing and revealing a handle fastener extending axially from an end of the side handle. Accordingly, the step of installing the bolt in the first fastener bore is performed with the handle fastener extending axially from the end of the side handle.

In another embodiment where the kit includes a first ring connector and a second ring connector, the method includes installing a second bolt in a second fastener bore with the second bolt extending through the fastener opening of a second ring connector.

In some embodiments, the method includes providing an auxiliary bolt sized and configured for installation into one of the fastener bores in the gear housing and installing the auxiliary bolt into a second fastener bores in the gear housing with the auxiliary bolt extending through the fastener opening of a second ring connector. For example, the first fastener bore and the second fastener bore are located on opposite lateral sides of the gear housing.

In another embodiment, each ring connector also defines a sling opening and the sling defines a first eye on the first end portion and defines a second eye on the second end portion. Accordingly, the step of connecting the sling to the ring connectors includes passing the sling through the sling opening of each ring connector and defining the tether-connector loop by either (i) passing the first eye through the second eye or (ii) overlapping the first eye with the second eye. For example, the ring connectors are figure-eight rings.

In some embodiments, the power hand tool is a grinder, a polisher, a cut-off tool, or a drill. The power hand tool may be powered by electricity, compressed air, or hydraulic pressure.

In another embodiment, the method includes positioning the first ring connector and the second ring connector so that the sling opening extends upward and rearward relative to the gear housing, thereby positioning the tether-connector loop adjacent the top surface of the power hand tool and rearward of the gear housing.

Another method of tethering a power hand tool includes the steps of providing a power hand tool to be tethered, wherein the power hand tool has a top surface, an elongated tool body extending to a gear housing on a forward end of the tool body and defining fastener bores in opposite sides of the gear housing, a hand grip on the elongated tool body, and a removable side handle installed in a first fastener bore; providing a tethering assembly that includes a first figure-eight ring connector and a second figure-eight ring connector each defining a fastener opening and a sling opening, and a wire rope sling extending between and linking the first figure-eight connector and the second figure-eight connector, where the wire rope sling defines a tether-connector loop configured for attachment of a tether when the tethering assembly is installed on the power hand tool; removing the removable side handle from the gear housing, thereby revealing the first fastener bore in the gear housing and revealing a handle fastener extending axially from an end of the side handle; aligning the fastener opening of the first figure-eight ring connector with the first fastener bore in the gear housing; installing the handle fastener in the first fastener bore with the handle fastener extending through the fastener opening of the first figure-eight ring connector; aligning the fastener opening of the second figure-eight ring connector with a second fastener bore in the gear housing; installing an auxiliary bolt in the second fastener bore with the auxiliary bolt extending through the fastener opening of the second figure-eight ring connector; and connecting the tether to the tether-connector loop; where the wire rope sling extends over the top surface of the power hand tool and between the first figure-eight connector and the second figure-eight connector with the tether-connecting loop extending rearwardly of the gear housing.

In some embodiments, the tethering assembly also includes an auxiliary bolt sized for installation into one of the fastener bores.

In another embodiment, the step of providing the tethering assembly includes selecting the wire rope sling with a first eye capturing the first figure-eight ring connector and a second eye capturing the second figure-eight ring connector.

In another embodiment, the step of providing the tethering assembly includes selecting the wire rope sling defining a closed loop extending through the first figure-eight connector and through the second figure-eight connector, and having a leg extending from the closed loop to the tether-connector loop. In one embodiment, the sling opening of the figure-eight connectors are sized to prevent the eyes of the wire rope sling from passing.

In one embodiment, for example, the leg is sized to function as the tether and connect the user to the power hand tool. In such embodiments, it is useful to select the tether-connector loop as a connector operable between an open position and a closed position. A carabiner is an example of such a connector.

In another embodiment, the step of providing the tethering assembly includes selecting the wire rope sling having a first end portion with a first eye connected through the sling opening of the first figure-eight connector and a second end portion with a second eye connected through the sling opening of the second figure-eight connector.

In another embodiment, the step of providing the tethering assembly includes selecting the wire rope sling with the tether-connector loop defined by an eye formed along the middle portion of the wire rope sling.

Another aspect of the present invention is directed to a tethering assembly for a power hand tool such as an angle grinder or the like. In one embodiment, a tethering assembly includes a first ring connector and a second ring connector each defining a fastener opening and a sling opening, and a wire rope sling with a sling leg extending between a first end portion with a first eye and a second end portion with a second eye. The first eye is connected through the sling opening of the first ring connector and the second eye is connected through the sling opening of the second ring connector, thereby linking the first ring connector to the second ring connector. For example, the eyes are formed to capture the ring connector.

In another embodiment, a middle portion of the sling leg defines a third eye. For example, the leg is folded and crimped to define a third eye located between the first eye and the second eye.

In another embodiment, the first ring connector and the second ring connector have a figure-eight shape.

In another embodiment, the tether-connector loop is a closed-loop connector operable between an open position and a closed position.

In another embodiment, the tethering assembly includes a tether with a closed-loop connector on the first tether end and a second closed-loop connector on the second tether end.

In another embodiment, the tethering assembly also includes a closed-loop connector attached to the sling leg between the first end portion and the second end portion. The closed-loop connector may be a carabiner, figure-eight ring, or other connector.

Yet another aspect of the present invention is directed to the combination of a power hand tool and a tethering assembly. In one embodiment, the power hand tool has a top surface, an elongated tool body extending to a gear housing on a forward end of the tool body and defining fastener bores in opposite sides of the gear housing, a hand grip on the elongated tool body, and a removable side handle installed in one of the fastener bores with a handle fastener. Any of the tethering assembly embodiments discussed may be combined with the power hand tool. In one exemplary embodiment, the tethering assembly includes a first ring connector and a second ring connector each defining a fastener opening and a sling opening, and a wire rope sling with a sling leg extending between a first end portion with a first eye and a second end portion with a second eye, where the first eye is connected through the sling opening of the first ring connector and the second eye is connected through the sling opening of the second ring connector, thereby linking the first ring connector to the second ring connector. The tethering assembly optionally includes an auxiliary bolt. The side handle is installed in one of the fastener bores on a first side of the gear housing with the handle fastener extending through the fastener opening of the first ring connector and an auxiliary bolt is installed in another of the fastener bores on a second side of the gear housing with the auxiliary bolt extending through the fastener opening of the second ring connector. The sling leg extends over the top surface of the power hand tool and is positioned for attachment to a tether without interfering with operation of the power hand tool.

In another embodiment of the combination, the tethering assembly further comprises a closed connector coupled to the sling leg, such as a carabiner or figure-eight ring.

In another embodiment, the combination includes a tether connected to the wire rope sling. For example, the tether is connected to the tether-connector loop using a carabiner or other closed-loop connector on the tether.

DETAILED DESCRIPTION OF THE PREFERRED EMBODIMENT

The preferred embodiments of the present invention are illustrated in FIGS. 1-9. As used herein, the terms "up," "down," "forward," "rearward," "top," "bottom," and similar terms refer to the orientation of a power hand tool 10 as it is typically oriented during display or use, where the tool body 12 extends generally horizontally from a gear housing 16. These terms are used for convenience in describing the present invention and do not limit the use or structure of the invention to any specific orientation or to use with any particular power hand tool 10. For the purposes of this disclosure, "power hand tool" includes tools that are electric, pneumatic, and hydraulic and are operated while held in the user's hands.

Figure 1:
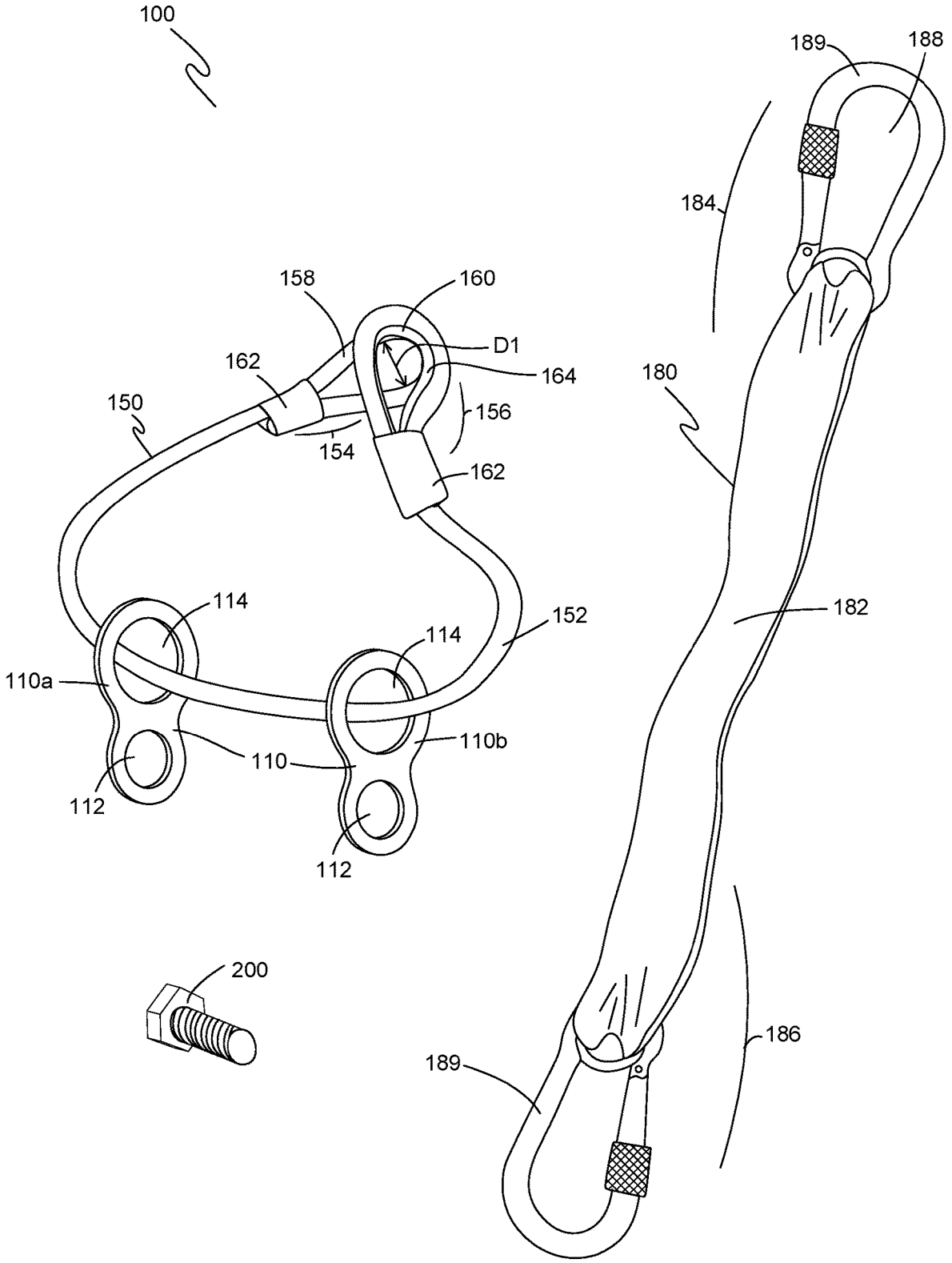
FIG. 1 illustrates a perspective view of one embodiment of a tethering assembly of the present invention showing a pair of ring connectors in the shape of a figure-eight, a wire rope sling coupled to and linking the ring connectors, and a tether with closed-loop connectors at each end.

FIG. 1 illustrates a perspective view of one embodiment of a tethering assembly 100. Tethering assembly 100 includes one or more ring connectors 110, a sling 150 that can be assembled with the ring connector(s) 110, an optional tether 180, and an optional auxiliary fastener 200. In the embodiment of FIG. 1, tethering assembly 100 includes a first ring connector 110*a* and a second ring connector 110*b* each having the shape of a figure-eight, which are also called figure-eight rings. In one embodiment, auxiliary fastener 200 is configured as a machine screw or bolt sized to threadably engage fastener bores 28 in power hand tool 10 (shown in FIG. 5).

Sling 150 is constructed as a wire rope sling and has one or more legs 152 that extend between a first end portion 154 and a second end portion 156. As shown in FIG. 1, sling 150 has one leg 152 and is sometimes referred to as an eye-and-eye cable sling or a lifting sling. First end portion 154 defines a first eye 158 and second end portion 156 defines a second eye 160. Typically, first eye 158 and second eye 160 are formed by mechanical splicing that includes a crimp 162. For example, first and second eyes 158, 160 are formed with Flemish eye splicing techniques as known in the art. Optionally, one or both eyes 158, 160 includes a thimble 164 for increased strength and reduced wear. In one embodiment, for example, each of first and second eyes 158, 160 has an inner diameter D1 of about ⅜ inch. Inner diameter D1 may be larger or smaller as determined adequate for connecting to a connector 189 on tether 180.

Each ring connector 110 defines a fastener opening 112 and a sling opening 114. Fastener opening 112 is sized for a handle fastener 26 extending from the tool's side handle (shown in FIG. 5). For some hand tools 10, handle fastener 26 is a ¼-20 threaded bolt or metric equivalent. Regardless of the particular handle fastener 26 used to engage the fastener bore 28 on power hand tool 10 (e.g., shown in FIG. 5), fastener opening 112 of each ring connector 110 is sized so that ring connector 110 can be engaged by the side handle 24, handle fastener 26, or auxiliary bolt 200 (and washer 27, if used) and tightened against the power hand tool 10. In one embodiment, for example, fastener opening 112 has a diameter of about ⅜ inch. Other diameters for fastener opening 112 are acceptable and are selected by the handle fastener 26 of the hand tool 10 to be tethered.

In some embodiments, sling opening 114 is sized to permit passage of first and/or second eye 158, 160 of sling 150. In other embodiments, sling opening 114 is sized to prevent passage of sling 150, but may require eyes 158, 160 to be formed after extending leg 152 through sling opening 114 of each ring connector 110. In one embodiment, for example, sling opening 114 has a diameter of ¾ inch. In another embodiment, sling opening 114 has a diameter of ¼ inch.

In some embodiments, fastener opening 112 and sling opening 114 are distinct from each other; in other embodiments, fastener opening 112 and sling opening 114 intersect to define a single opening, such as one with an hourglass shape.

In one embodiment, tethering assembly 100 includes optional tether 180 and/or one or more bolts 200 sized for a threaded bolt bore 28 of the hand tool 10. Tether 180 can be connected between cable 150 and the worker, a structure, or some other object.

Optional tether 180 has a tether body 182 that extends between a first tether end portion 184 and a second tether end portion 186. Each of first and second tether end portions 184, 186 defines a closed loop 188, where one or more of closed loops 188 is a closed-loop connector 189 operable between an open position and a closed position. As such, first tether end portion 184 may be attached to the user or to a structure, and second tether end portion 186 may be attached to sling 150. For example, connector 189 on second tether end portion 186 is a carabiner sized to be attached through one or both of first and second eyes 158, 160.

Figure 2:
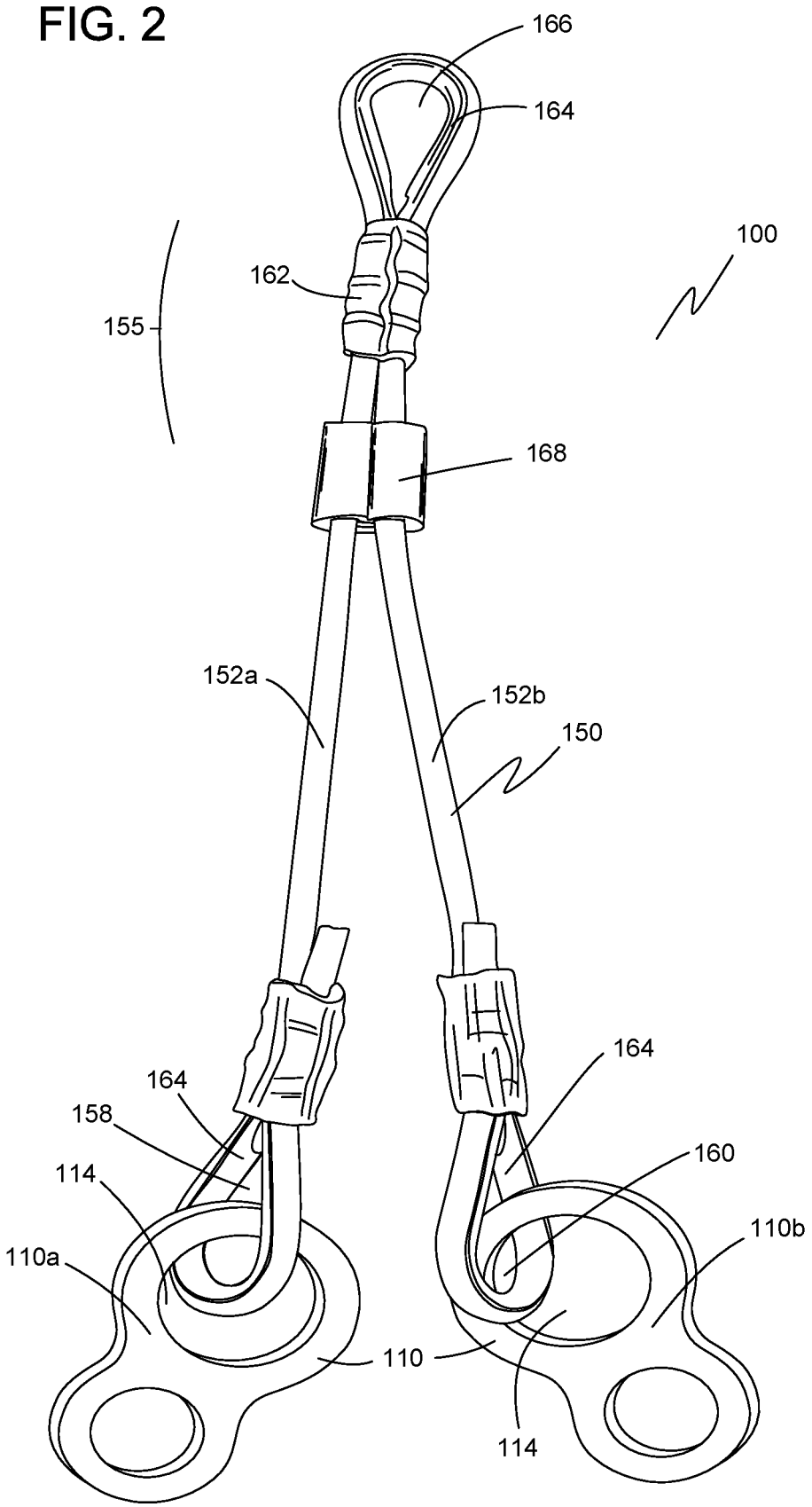
FIG. 2 illustrates another embodiment of a tethering assembly of the present invention showing a wire rope sling with a tether-connector loop and a pair of sling legs, where each leg terminates in an eye connected through a ring connector.

Referring now to FIG. 2, another embodiment of tethering assembly 100 is shown. Here, sling 150 defines a tether-connector loop 166 with a first leg 152*a* and a second leg 152*b* extending from tether-connector loop 166 to respective first and second eyes 158, 160. In one embodiment, tether-connector loop 166 is an eye formed by bending middle portion 155 of sling 150 to form a loop and installing crimp 162. First and second end portions 154, 156, respectively, define first and second eyes 158, 160 that extend through sling openings 114 of first and second ring connectors 110*a*, 110*b*, respectively. In contrast to tethering assembly 100 of FIG. 1, sling 150 is permanently connected to ring connectors 110 by forming first and second eyes 158, 160 that each connect through and capture one ring connector 110. Optionally, any one or more of tether-connector loop 166, first eye 158, and second eye 160 includes thimble 164 for improved strength and abrasion resistance. Optionally, sling 150 includes a slider 168 that captures and slides along first leg 152*a* and second leg 152*b* between tether-connector loop 166 and first and second eyes 158, 160. The user may position slider 168 to take up slack in sling 150 and maintain sling 150 positioned behind the gear housing 16 of power hand tool 10 as shown, for example, in FIG. 7.

Figure 3:
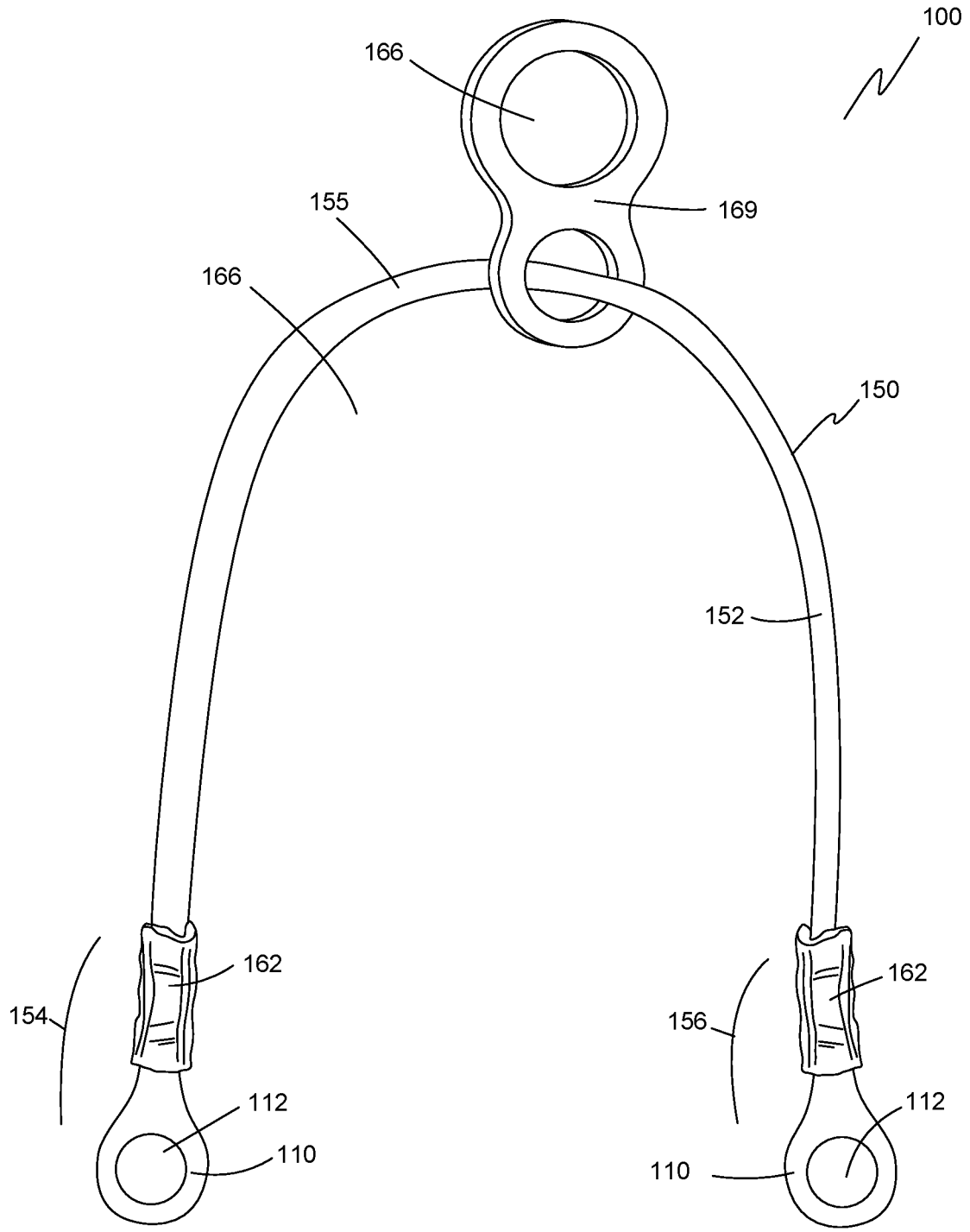
FIG. 3 illustrates another embodiment of a tethering assembly of the present invention showing a sling fixedly attached to ring connectors at each end and includes a ring connector slidably coupled to the sling along a middle portion and defining a tether-connector loop.

Referring now to FIG. 3, another embodiment of tethering assembly 100 is shown in a front view. Here, leg 152 of sling 150 extends between first end portion 154 and second end portion 156. Ring connectors 110 are mechanically fastened to first end portion 154 and second end portion 156 of leg 152 by crimps 162. Other mechanical attachment methods are also acceptable. Ring connectors 110 are permanently attached to sling 150 and define only fastener openings 112. When installed on power hand tool 10, sling 150 extends over power tool 10 to define a closed loop 167 useful as tether-connector loop 166. Optionally, a connector 169 is installed on sling 150 to define tether-connector loop 166. Tether 180 may connect to tether-connector loop 166 as defined by a connector if present, or may connect directly to sling 152.

Figure 4:
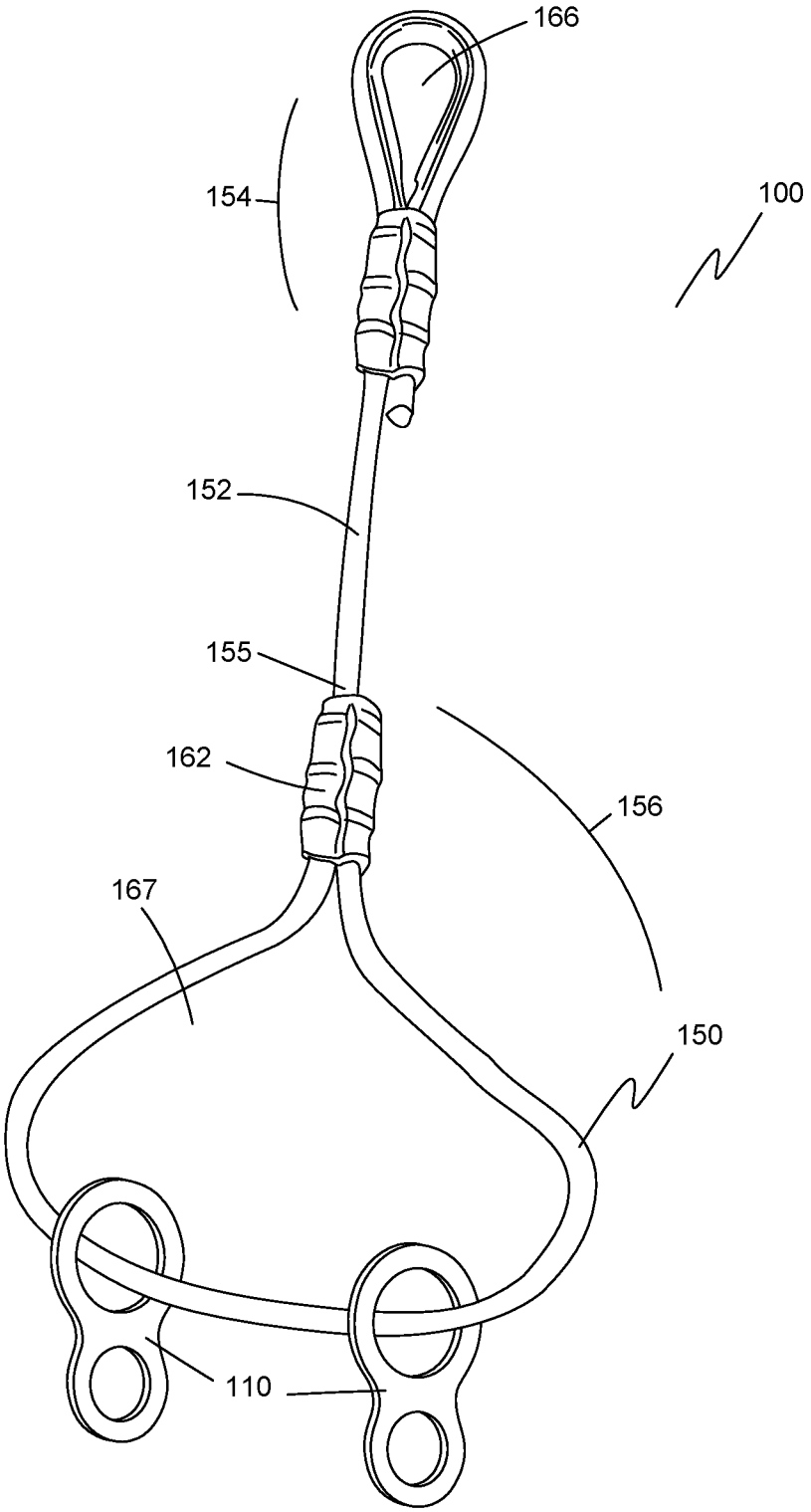
FIG. 4 illustrates another embodiment of a tether assembly of the present invention showing a first end portion of a sling having an eye for use as a tether-connector loop and a second end portion defining a closed loop that extends through first and second ring connectors.

Referring now to FIG. 4, another embodiment of tethering assembly 100 shown. Here, sling 150 has a single leg 152 extending between a closed loop 167 formed by second end portion 156 and tether-connector loop 166 formed by first end portion 154. Second end portion 156 extends through sling openings 114 of two ring connectors 110 and then is joined to middle portion 155 with crimp 162 to define closed loop 167 that captures ring connectors 110. Here, tether-connector loop 166 is configured as an eye formed by first end portion 154. In other embodiments, tether connector loop 166 is a closed-loop connector operable between an open position and a closed position, such as a carabiner. Leg 152 may be as short or as long as desired. In one embodiment, leg 152 is sized so that the fastener of tether connector loop 166 can be removably attached to a worker or other object. In other embodiments, leg 152 is about two to four inches in length so that tether-connector loop 166 is positioned for attachment to tether 180 along a top surface 12*a* of a tool handle 12 (shown in FIG. 8).

Figure 5:
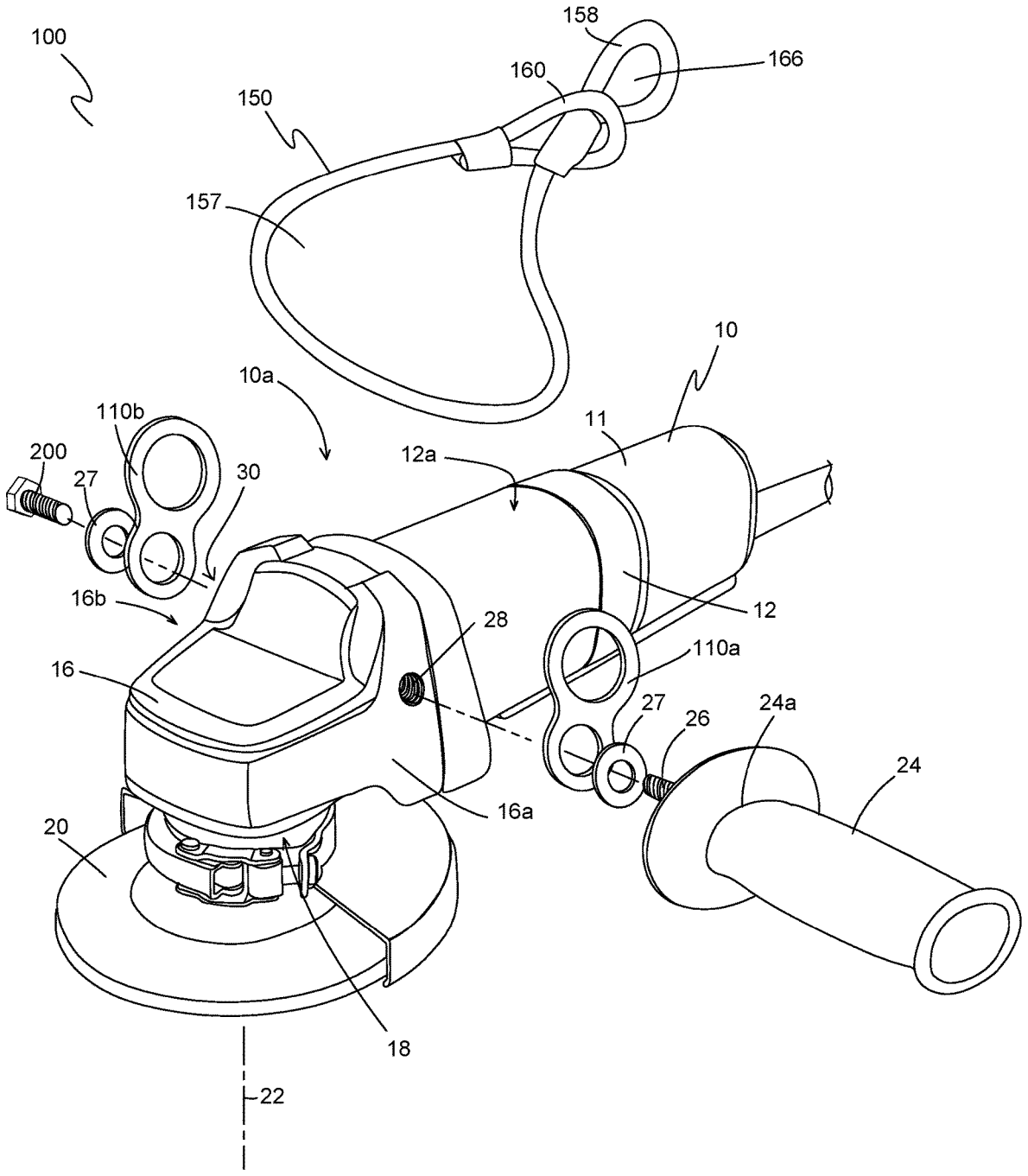
FIG. 5 illustrates a front perspective view of the tether assembly and power tool showing the tethering assembly of FIG. 1 installed on a power angle grinder.

FIG. 5 illustrates a front and side perspective view showing installation of one embodiment of tethering assembly 100 on power hand tool 10. As shown, power hand tool 10 is configured as a grinder (a.k.a. angle grinder or cut-off tool) with an elongated tool body 12 extending to a gear housing 16. Tool body 12 includes a hand grip 11. Gear housing 16 has a rotating shaft 18 or other moving parts. Rotating shaft 18 extends down from gear housing 16 to rotate cutting wheel 20 about an axis of rotation 22 extending in a vertical direction and generally perpendicular to tool body 12. Power hand tool 10 also has a side handle 24 that attaches to gear housing 16 by handle fastener 26 extending axially from an end 24*a* of side handle 24 to engage a fastener bore 28 in first side 16*a* of gear housing 16. A second fastener bore 30 (not visible) is formed in a second side 16*b* of gear housing 16 and provides an alternate installation location for side handle 24. Optional washers 27 may be used with handle fastener 26 and/or auxiliary fastener 200 to better engage ring connectors 100. First eye 158 of sling 150 extends through second eye 160 to define closed loop 167 and tether-connector loop 166.

Figure 6:
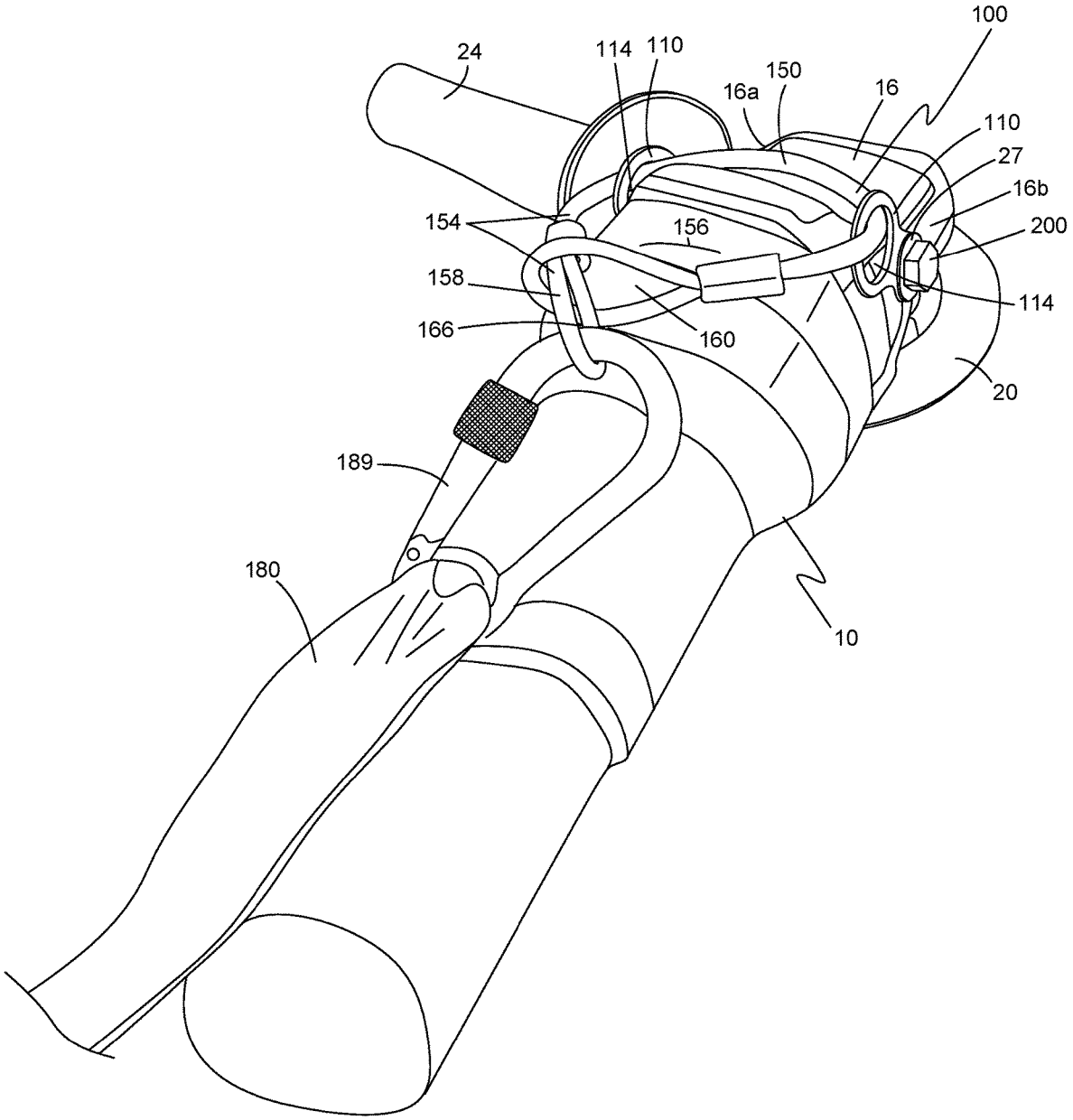
FIG. 6 illustrates a rear perspective view of the tether assembly and power tool showing the tethering assembly of FIG. 1 installed on an angle grinder, where one eye passes through the other eye of the wire rope sling and connects to a tether.

FIG. 6 illustrates a top and rear perspective view of tethering assembly 100 of FIG. 1 installed on power hand tool 10 configured as an angle grinder. Tethering assembly 100 includes ring connectors 110, sling 150, tether 180, and auxiliary fastener 200. Ring connectors 110 are attached to first and second sides 16*a*, 16*b* of gear housing 16, where handle fastener 26 of side handle 24 and auxiliary fastener 200, respectively, extend through fastener openings 112 (not visible). Side handle 24 and auxiliary fastener 200 are tightened against ring connectors 110 with washer 27 to maintain the positions of ring connectors 110 on gear housing 16. Preferably, ring connectors 110 are positioned as shown to extend upward and rearward from fastener openings 28, 30 relative to gear housing 16 in order to position tether 180 away from cutting wheel 20 or other working part of power hand tool 10. Sling 150 extends through sling openings 114 of each ring connector 110. First end portion 154 extends through second eye 160 on second end portion 156 of sling 150 in a slip-knot configuration, where first eye 158 is used as and defines tether-connector loop 166. In other configurations, first eye 158 and second eye 160 are brought together in overlapping alignment to define tether-connector loop 166 as shown, for example, in FIG. 1. In such cases, connector 189 of tether 180 is attached through both first and second eyes 158, 160.

Figure 7:
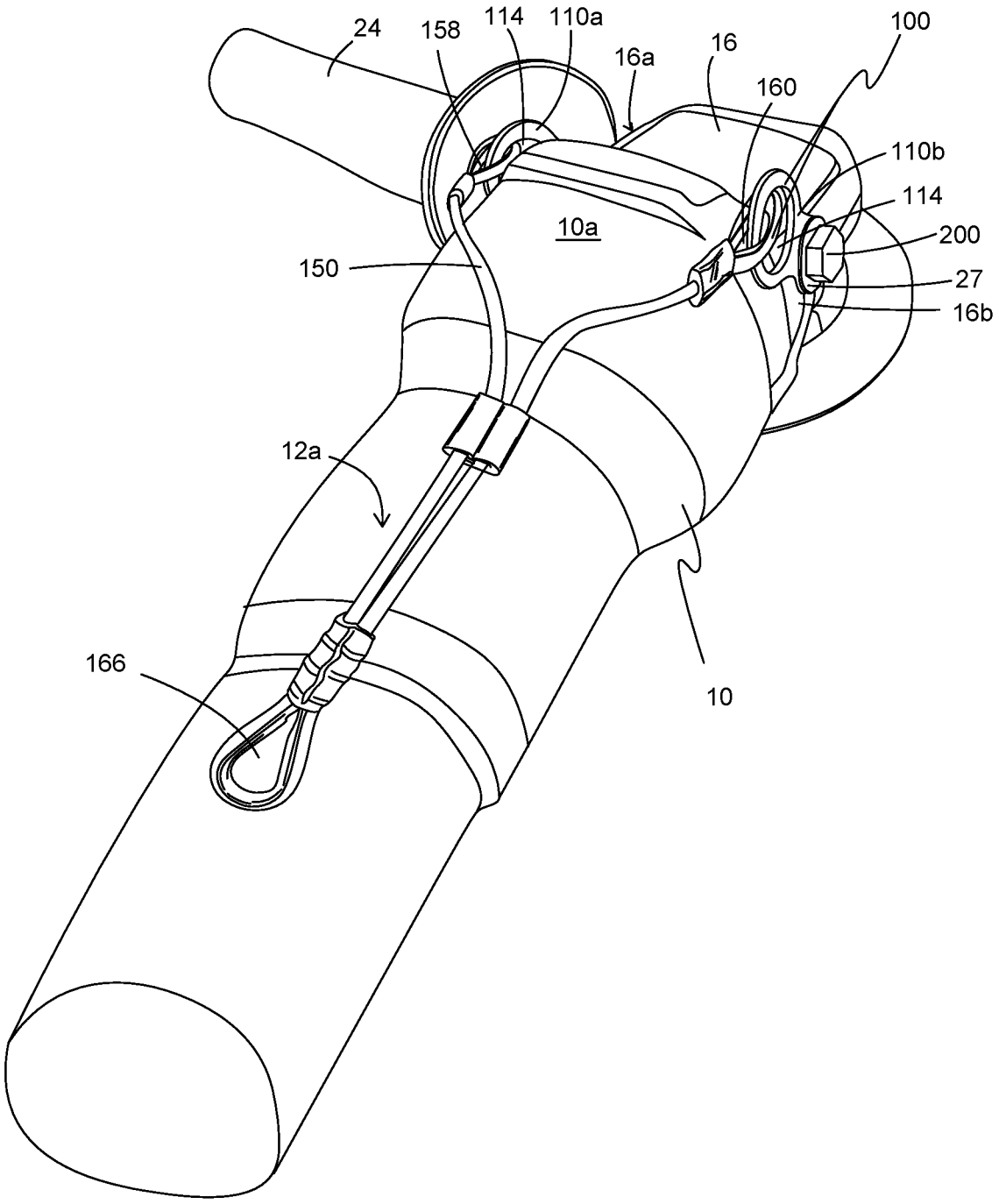
FIG. 7 illustrates a rear perspective view of the tether assembly and power tool showing the tethering assembly of FIG. 2 installed on an angle grinder.

FIG. 7 illustrates a top and rear perspective view of tethering assembly 100 of FIG. 2 installed on power hand tool 10 configured as a grinder. Tethering assembly 100 includes sling 150 with attached first and second ring connectors 110*a*, 110*b*, and auxiliary fastener 200. Similar to the installation for the embodiment of attachment assembly 100 of FIG. 1, each of first and second ring connectors 110*a*, 110*b* is attached to first side 16*a* or second side 16*b*, respectively, of gear housing 16. Handle fastener 26 (not visible) of side handle 24 extends through fastener opening 112 of first ring connector 110*a*. Auxiliary fastener 200 extends through fastener opening 112 of second ring connector 110*b*. Side handle 24 and auxiliary fastener 200 are tightened with washer 27 against ring connectors 110*a*, 110*b* to maintain the positions of ring connectors 110*a*, 110*b* on gear housing 16. First and second eyes 158, 160 of sling 150 are configured to extend through sling openings 114 of first and second ring connectors 110*a*, 110*b* so that first and second ring connectors 110*a*, 110*b* are permanently attached to sling 150. First eye 158 is connected through and captures a first ring connector 110*a* and second eye 160 is connected through and captures second ring connector 110*b*. First and second ring connectors 110*a*, 110*b* are preferably positioned to extend upward and rearward of gear housing 16 from fastener bores 28, 30 (not visible). Accordingly, sling 150 is positioned to extend rearward along a top surface 12*a* of tool body 12 with tether-connector loop 166 positioned for attachment to tether 180 (shown in FIG. 1).

The tethering assembly 100 of FIG. 3 may be installed similarly to the installation as shown in FIG. 7. First and second ring connectors 110*a*, 110*b* can be secured to opposite sides 16*a*, 16*b* of gear housing 16 with leg 152 extending rearwardly over a top surface 10*a* of power hand tool 10. Tether-connector loop 166 is then positioned adjacent top surface 12*a* of tool body 12 to connect to tether 180.

Figure 8:
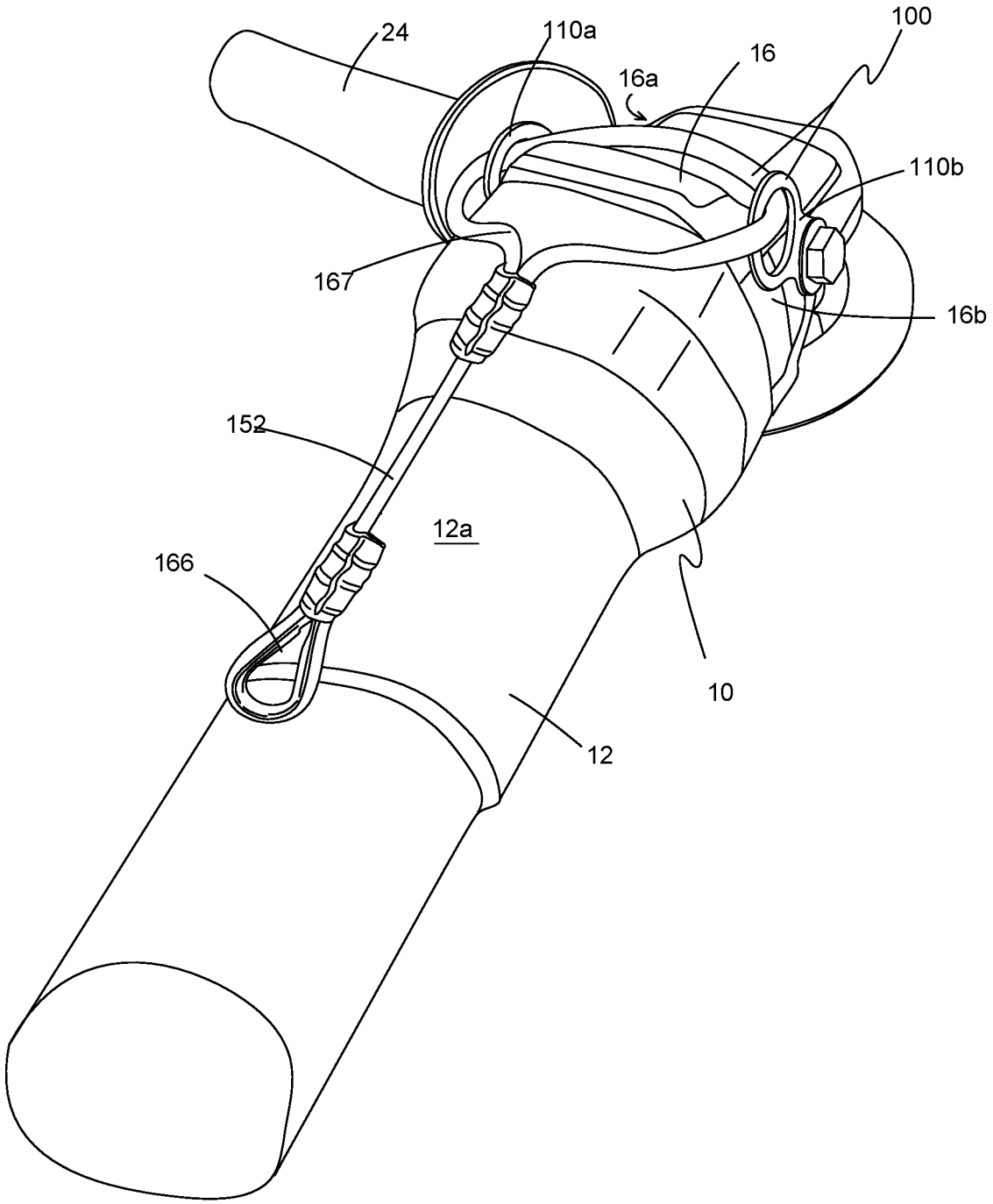
FIG. 8 illustrates a top and rear perspective view of the tether assembly and power tool showing the tethering assembly of FIG. 4 installed on an angle grinder.

FIG. 8 illustrates a top and rear perspective view of tethering assembly 100 of FIG. 4 installed on power hand tool 10 configured as a grinder. First and second ring connectors 110*a*, 110*b* are attached to opposite first and second sides 16*a*, 16*b* of gear housing 16, respectively.

Handle fastener 26 (not visible) of side handle 24 and auxiliary fastener 200 extend through respective fastener openings 112. Side handle 24 and auxiliary fastener 200 are tightened against first and second ring connectors 110*a*, 110*b*, respectively, to maintain their positions on gear housing 16. Sling 150 defines closed loop 167 extending to leg 152 behind first and second ring connectors 110*a*, 110*b* and to tether-connector loop 166 adjacent top surface 12*a* of tool body 12.

Figure 9:
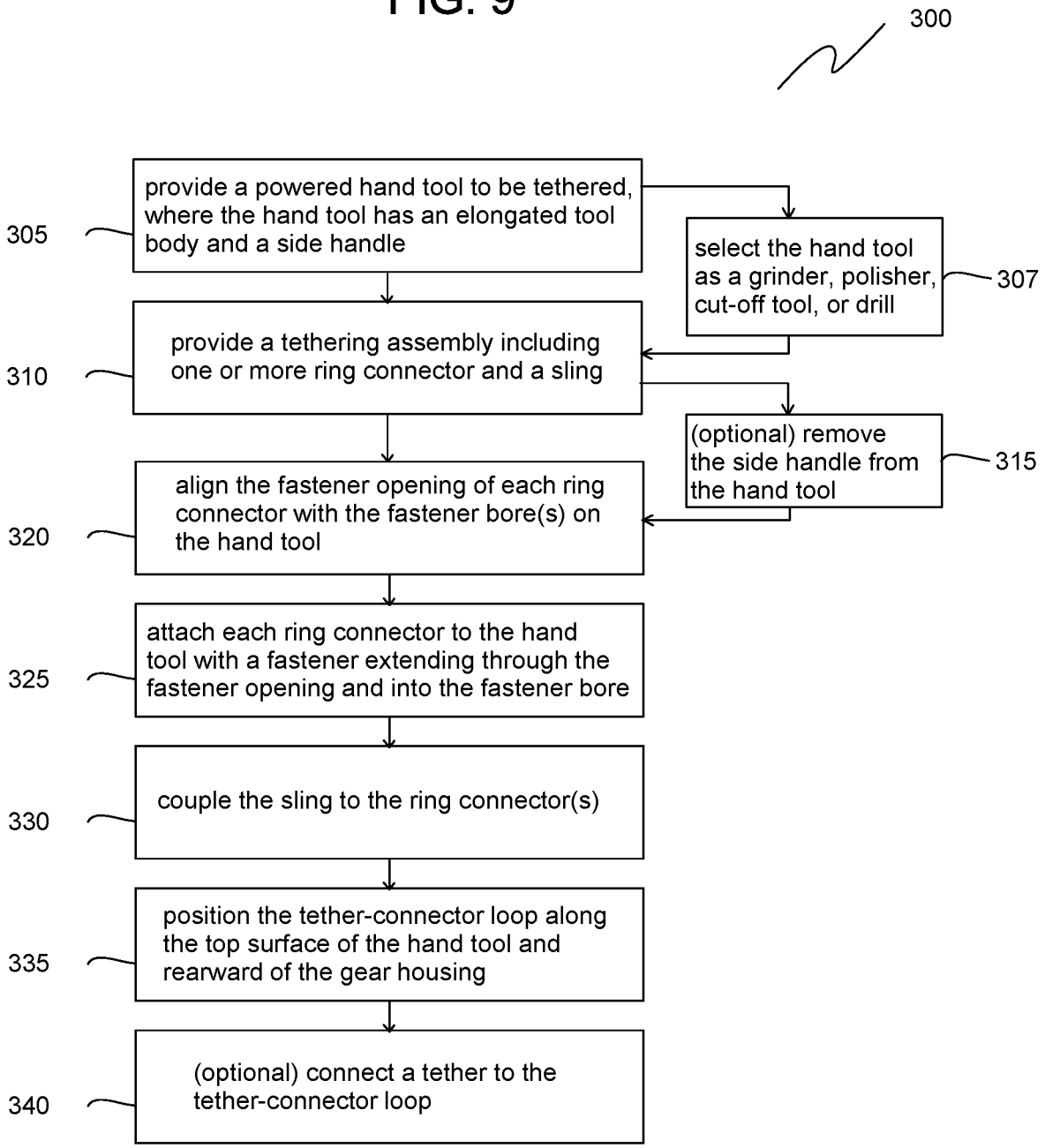
FIG. 9 is a flow chart showing exemplary steps in a method of tethering a power hand tool.

Referring now to FIG. 9, a flow chart illustrates exemplary steps of a method 300 of tethering a power hand tool 10 having a side handle 24. In step 305, a power hand tool 10 is provided, where the power hand tool 10 has a top surface 10*a*, an elongated tool body 12 with a hand grip 11 on the tool body 12 and a side handle 24 threadably attached to a first side 16*a* or second side 16*b* of a gear housing 16. In some embodiments, the power hand tool 10 is selected in step 307 as a grinder, a polisher, a cut-off tool, or a drill.

In step 310, a tethering assembly 100 is provided. Tethering assembly 100 includes one or more ring connectors 110 each defining a fastener opening 112. Tethering assembly 100 also has a sling 150 connected to the ring connector(s) 110 and defining a tether-connector loop 166 when installed on the power hand tool 10. In some embodiments, tethering assembly 100 includes two ring connectors 110 configured to be installed on opposite sides 16*a*, 16*b* of the gear housing 16 of the power hand tool 10. In some embodiments, each ring connector 110 is selected as a figure-eight ring that defines a fastener opening 112 and a sling opening 114. In other embodiments, the ring connectors 110 define only a fastener opening 112 and are mechanically attached to the sling 150. In some embodiments, the tether-connector loop 166 is the sling extending over the power hand tool 10 between first and second ring connectors 110, or a closed loop or eye formed by sling 150, where a tether 180 can be attached to the tether-connector loop 166. Various examples of tethering assembly 100 are discussed above with respect to FIGS. 1-4. Other variations are acceptable.

In optional step 315, the side handle 24 is removed from the power hand tool 10. Typically, side handle 24 is threadably attached to one side 16*a*, 16*b* of the gear housing 16. When the side handle 24 is removed, a threaded bolt bore 28 is revealed in the gear housing 24 (or other side portion of power hand tool 10) as well as a handle fastener 26 extending from an end of the side handle 24. In other embodiments of method 300, a single ring connector 110 is provided and is installed using a second bolt bore 30 on the opposite of the gear housing 16 from the side handle 24.

In step 320, the fastener opening 112 of each ring connector 110 is aligned with a bolt bore 28, 30 on the power hand tool 10, where the bolt bore 28, 30 is sized and configured to receive the handle fastener 26 of the side handle 24. In one embodiment where the tethering assembly 100 includes two ring connectors 110, the fastener opening 112 of a first ring connector 110*a* is aligned with a first bolt bore 28 on the first side 16*a* of the gear housing 16 and the fastener opening 112 of a second ring connector 110*b* is aligned with a second bolt bore 30 on the opposite second side of the gear housing 16.

In step 325, each ring connector 110 of the tethering assembly 100 is secured to the power hand tool 10 with a bolt extending through the fastener opening 112. In some embodiments, the bolt is the handle fastener 26 of the side handle 24, where the side handle 24 is installed on the gear housing with the handle fastener 26 extending through the fastener opening 112 of a ring connector 110. In other embodiments, the bolt is auxiliary fastener 200 installed into second bolt bore 30 opposite of the side handle 24 with the auxiliary fastener 200 extending through the fastener opening 112 of the ring connector 110. In some embodiments, side handle 24 and/or the handle fastener 26 is a replacement part. For example, a replacement handle fastener 26 is provided and installed into the side handle 24 in place of the existing handle fastener 26, where the replacement handle fastener 26 has a longer length to accommodate the ring connector 110. Optionally, the ring connector(s) 110 are positioned to extend upward and/or rearward of the gear housing 16.

In some embodiments, the tethering assembly 100 includes first and second ring connectors 110*a*, 110*b*. A first ring connector 110*a* is installed using a first bolt bore 28 and a second ring connector is installed using a second bolt bore 30, usually on an opposite side 16*a* or 16*b* of the gear housing 16. For example, the first ring connector 110*a* is installed using handle fastener 26 and side handle 24. The second ring connector 110 is installed on the power hand tool 10 with a fastener, such as auxiliary fastener 200, extending through the fastener opening 112 of the second ring connector 110*b* and engaging second bolt bore 30. Step 325 optionally includes providing the auxiliary fastener 200 as part of the tethering assembly 100.

In step 330, the sling 150 is connected to the ring connector(s) 110 if not already connected. In one embodiment, step 335 includes passing the sling 150 through the sling opening 114 of each ring connector, such as shown in FIG. 1 or FIG. 4. In other embodiments, sling 150 starts as a wire rope or the like that is passed through each sling opening 114 and formed into an eye that captures the ring connector 110, such as shown in FIG. 2. Step 330 may also include attaching a ring connector or forming tether-connector loop 166 in middle portion 155 of sling 150. In some embodiments, step 330 is performed prior to step 320 of aligning each fastener opening 112 with a bolt bore 28, 30. In some embodiments, step 330 also includes mechanically splicing the sling to form an eye or loop, such as with a crimp 162.

In step 335, a tether-connector loop 166 is positioned away from the working part (e.g., cutting wheel 20) for connection to a tether 180. Preferably, the tether-connector loop 166 extends or is positioned to extend rearward from the gear housing 16 along the top surface 12*a* of the tool body 12. In some embodiments, the tether-connector loop 166 is formed by sling 150 extending between ring connectors 110. In one embodiment, eyes 158, 160 of sling 150 are brought together and overlapped for connection to the tether 180. In another embodiment, one eye 158 extends through another eye 160 in a slip-knot fashion and is used as the tether-connector loop 166. In other embodiments, sling 150 defines an eye or includes a connector on the sling 150 as the tether-connector loop 166. In some embodiments, the sling 150 is positioned to extend over the top surface 12*a* of the power hand tool 10 between first and second connector rings 110*a*, 110*b*.

In optional step 345, a tether 180 is connected to the tether-connector loop 166. The tether 180 may also be connected to the worker or to a nearby structure or other object.

In use, embodiments of tethering assembly 100 provide reliable tethering attachment for power hand tools 10, such as grinders, polishers, cut-off tools, and some heavy-duty drills, where power hand tool 10 has a hand grip 11 on the tool body 12 and a side handle 24 attached to the gear housing 16. By positioning the tether-connector loop 166 away from the working part of the tool, such as rearward of the gear housing 16, a tether 180 connected to tether-connector loop 166 is generally positioned out of the way of the working part of the tool (e.g., cutting wheel 20). For example, the sling 150 and tether 180 extend rearwardly along the top or side of the tool body 12 where the worker may grab the hand grip 11 without the sling 150 or tether 180 preventing use of the power hand tool 10 or interfering with function of the power hand tool 10.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A combination of a power hand tool and a tethering assembly, comprising:

the power hand tool selected from the group consisting of a grinder, a polisher, a cut-off tool, and a drill, the hand tool having a gear housing with a fastener bore configured and arranged to receive a fastener, wherein the fastener bore includes a first fastener bore on a first side of the gear housing and a second fastener bore on a second side of the gear housing;

the tethering assembly comprising:

a connector having a fastener opening, wherein the connector includes a first connector having a first fastener opening and a second connector having a second fastener opening; and a tether configured and arranged to be connected to the connector, wherein the fastener includes a first fastener extending through the first fastener opening and into the first fastener bore and a second fastener extending through the second fastener opening and into the second fastener bore thereby connecting the connector and the power hand tool; and wherein the tether is configured and arranged to be selectively coupled to one of a worker and an anchor object thereby selectively interconnecting the connector and the one of the worker and the anchor object.

2. The combination of claim 1, further comprising a sling interconnecting the first and second connectors and the tether being connected to the sling.

3. A combination of a power hand tool and a tethering assembly, comprising:

the power hand tool selected from the group consisting of a grinder, a polisher, a cut-off tool, and a drill, the hand tool having a gear housing with a fastener bore configured and arranged to receive a fastener, wherein the power hand tool includes a removable side handle having a handle fastener configured and arranged to engage the power hand tool within the fastener bore;

the tethering assembly comprising:

a connector having a fastener opening; and a tether configured and arranged to be connected to the connector; and wherein the fastener extends through the fastener opening and into the fastener bore thereby connecting the connector and the power hand tool; and wherein the tether is configured and arranged to be selectively coupled to one of a worker and an anchor object thereby selectively interconnecting the connector and the one of the worker and the anchor object.

4. The combination of claim 3, further comprising a sling interconnecting the connector and the tether.

5. The combination of claim 3, wherein the fastener is the handle fastener of the removable side handle.

6. The combination of claim 3, wherein the removable side handle extends from the gear housing.

7. The combination of claim 3, wherein the fastener bore includes a first fastener bore on a first side of the gear housing and a second fastener bore on a second side of the gear housing, the handle fastener engaging the power hand tool within the first fastener bore.

8. The combination of claim 7, wherein the fastener is the handle fastener of the removable side handle.

9. A combination of a power hand tool and a tethering assembly, comprising:

the power hand tool selected from the group consisting of a grinder, a polisher, a cut-off tool, and a drill, the hand tool having a gear housing with a fastener bore configured and arranged to receive a fastener;

the tethering assembly comprising:

a connector having a fastener opening; and a tether configured and arranged to be connected to the connector; and wherein the fastener extends through the fastener opening and into the fastener bore thereby connecting the connector and the power hand tool, the connector having a tether opening configured and arranged to receive a tether connector operatively connected to the tether; and wherein the tether is configured and arranged to be selectively coupled to one of a worker and an anchor object thereby selectively interconnecting the connector and the one of the worker and the anchor object.

10. A method of tethering a power hand tool, comprising:

providing a power hand tool selected from the group consisting of a grinder, a polisher, a cut-off tool, and a drill, the hand tool having a gear housing with a fastener bore configured and arranged to receive a fastener, wherein the power hand tool includes a removable side handle having a handle fastener configured to engage the power hand tool within the fastener bore;

providing a tethering assembly, comprising:

a connector having a fastener opening; and a tether configured and arranged to be connected to the connector;

aligning the fastener opening of the connector and the fastener bore of the gear housing;

installing a fastener through the fastener opening of the connector and into the fastener bore of the gear housing thereby connecting the connector and the power hand tool; and connecting the tether to the connector.

11. The method of claim 10, wherein the fastener is the handle fastener of the removable side handle.

12. A method of tethering a power hand tool comprising:

providing a power hand tool selected from the group consisting of a grinder, a polisher, a cut-off tool, and a drill, the hand tool having a gear housing with a fastener bore configured and arranged to receive a fastener;

providing a tethering assembly, comprising:

a connector having a fastener opening; and a tether configured and arranged to be connected to the connector;

aligning the fastener opening of the connector and the fastener bore of the gear housing;

installing a fastener through the fastener opening of the connector and into the fastener bore of the housing thereby connecting the connector and the power hand tool; and connecting the tether to the connector;

wherein the fastener bore includes a first fastener bore and a second fastener bore, wherein the connector includes a first connector with a first fastener opening and a second connector with a second fastener opening, and wherein the fastener includes a first fastener and a second fastener, further comprising:

aligning the first fastener opening of the first connector with the first fastener bore;

installing the first fastener through the first fastener opening and the first fastener bore;

aligning the second fastener opening of the second connector with the second fastener bore;

installing the second fastener through the second fastener opening and the second fastener bore; and connecting the tether to the first and second connectors.

13. The method of claim 12, further comprising connecting a sling to the first and second connectors and connecting the tether to the sling.

* * * * *